United States Patent [19]

Bowering

[11] Patent Number: 4,623,895

[45] Date of Patent: Nov. 18, 1986

[54] FLEXIBLE BROADBAND UHF ANTENNA

[75] Inventor: Cyril J. Bowering, Gloucester, Canada

[73] Assignee: Her Majesty the Queen in right of Canada, as represented by the Minister of National Defence of Her Majesty's Canadian Government, Ottawa, Canada

[21] Appl. No.: 600,644

[22] Filed: Apr. 16, 1984

[30] Foreign Application Priority Data

Apr. 29, 1983 [CA] Canada ..... 427000

[51] Int. Cl.[4] ..... H01Q 1/08; H01Q 9/38

[52] U.S. Cl. ..... 343/829; 343/846; 343/873; 343/881

[58] Field of Search ..... 343/715, 825, 829, 830, 343/846, 848, 872, 873, 880, 882, 888, 890, 900, 915, 881, DIG. 1

[56] References Cited

U.S. PATENT DOCUMENTS

| | | | |
|---|---|---|---|
| 2,493,514 | 1/1950 | Wehner | 343/830 |
| 2,558,763 | 7/1951 | Lee | 343/715 |
| 2,567,260 | 9/1951 | Wiley | 343/830 |
| 2,568,710 | 9/1951 | Bolljahn | 343/830 |
| 3,287,732 | 11/1966 | Altmayer | 343/888 |
| 4,148,037 | 4/1979 | Britten | 343/846 |
| 4,300,140 | 11/1981 | Brandigampola | 343/900 |

FOREIGN PATENT DOCUMENTS

| | | | |
|---|---|---|---|
| 1905444 | 9/1970 | Fed. Rep. of Germany | 343/873 |
| 2900269 | 7/1979 | Fed. Rep. of Germany | 343/715 |
| 1115291 | 4/1956 | France | 343/872 |

*Primary Examiner*—Eli Lieberman
*Assistant Examiner*—Michael C. Wimer
*Attorney, Agent, or Firm*—Sheldon Kanars; Jeremiah G. Murray; Edward Goldberg

[57] ABSTRACT

A compact lightweight flexible omnidirectional broadband UHF antenna of the fat monopole type is disclosed. The antenna comprises a braided copper sleeve molded inside a truncated cone of neoprene rubber. The antenna is suitable for vehicle or mast mounting. When mast mounted, the antenna may be associated with ground plane rods, each of which is mounted to a common support by means of a pivot with yieldable protuberances. The protuberances yield to the plane face of the support and will, therefore, enter recesses provided in the support in the rotational path of the protuberances. When the protuberances enter the recesses, the associated ground plane rod is locked in either an operational or a storage position.

9 Claims, 5 Drawing Figures

FLEXIBLE BROADBAND UHF ANTENNA

BACKGROUND OF THE INVENTION

1. Field of the Invention

This invention relates to antennas, and more particularly to broadband UHF antennas.

2. Description of the Prior Art

Broadband UHF antennas currently available include structures such as the discone, biconical, fat dipole and monopole types. In addition, there are designs employing simple radiating elements supplemented with other electrical components to provide the broadband characteristics. The antenna of this invention is of the fat monopole type which is a base fed quarter wave vertical cylindrical element having a relatively large diameter which is normally mounted over some form of ground plane.

Existing broadband structures are normally too cumbersome for vehicular use. The electrically matched devices are complex, expensive and less efficient. In all cases the existing designs are rigid assemblies which would require protection from brush damage when used in the military mobile role.

SUMMARY OF THE INVENTION

It is therefore an object of this invention to provide a broadband UHF antenna which is able to withstand conditions of vibration and shock such as may be encountered when the antenna is mounted to a vehicle in motion over rough terrain and through heavy brush.

Another object of this invention is to provide a broadband UHF antenna which is relatively inexpensive, lightweight and which does not require electrical matching circuits.

This is achieved with a broadband antenna comprising a hollow assembly of an electrically conductive sleeve supported along its length by flexible dielectric. The sleeve is constructed to permit transverse flexure of the antenna, with the dielectric material increasing the bandwidth of the antenna.

The usual fat monopole antenna has a bandwidth that increases with the ratio of its diameter to height. In a harsh environment, however, such as in the mobile military role, a flexible antenna is necessary. In order to obtain the necessary flexibility, the present antenna utilizes a diameter that is limited in size. A dielectric medium compensates for the small diameter so that the antenna covers a broad frequency range without recourse to matching circuits.

Particular embodiments of the invention will be described in conjunction with the accompanying drawings.

DESCRIPTION OF THE PREFERRED EMBODIMENT

Figure 1:
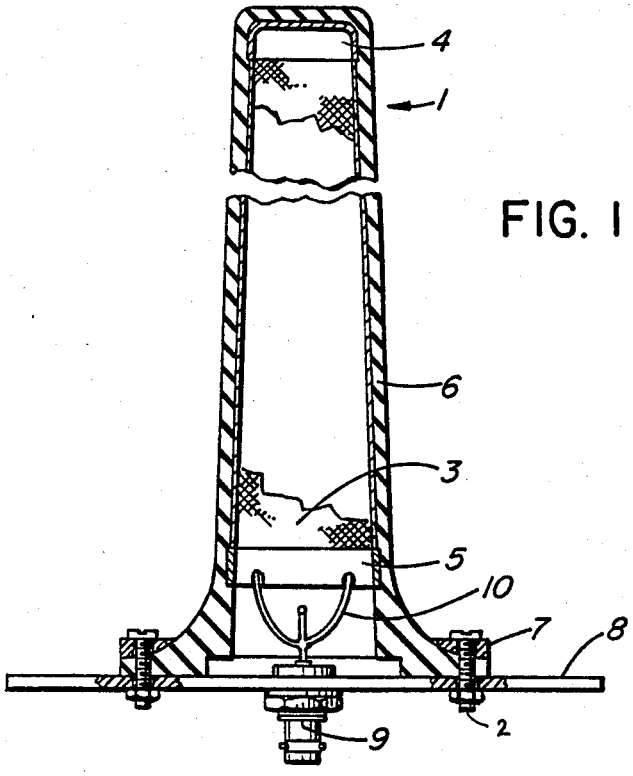
FIG. 1 is a side sectional view of the antenna of this invention.

Referring now to FIG. 1, the antenna of this invention is indicated generally at 1. A sleeve 3 of tightly braided copper wire with an outer base diameter of about 1½ inches and length of 11 inches has a brass cap 4 fitted over one end at the top of the antenna and brass ring 5 fitted over the other end at the base of the antenna. Neoprene rubber 6 is molded over the top and sides of the brass cap 4 and the sides of the sleeve 3 and brass ring 5 giving the antenna an outer diameter of about 2 inches. The rubber molding 6 extends one inch beyond the basal end of the copper sleeve in a direction parallel to the longitudinal axis of the sleeve so that the antenna has a total length of about 12 inches. This extension has an inner diameter approximately equal to the outer diameter of the sleeve, and has an increasing outer diameter in the direction away from the sleeve (and parallel to the longitudinal axis of the sleeve) so as to form a flared end.

The bottom surface of the flared end of the rubber molding is situated on antenna mounting plate 8. Metal securing ring 7 is positioned on the top surface of the flared end and bolts 2 extend through holes provided in the securing ring, the flared end, and mounting plate 8 in order to secure the rubber molding and sleeve assembly stop the mounting plate 8.

The extension of the rubber molding 6 provides a one inch gap between the end of the copper sleeve 3 and ring 5 and the mounting plate, thus minimizing antenna base capacitance.

Input connector 9 is connected to the mounting plate 8, and, by means of wires 10, to the braided sleeve 3. The antenna is base fed by means of a coaxial feed line which may be connected to the input connector 9.

For vehicle mounting, the mounting plate may be affixed to a swivel bracket which is in turn attached to the vehicle so that the antenna projects, at least in part, above the roof of the vehicle. The swivel bracket permits adjustment of the antenna so that it does not project over the roof of the vehicle for air transport purposes.

In the field, the rubber molding protects the interior structure of the antenna from damage due to the elements and from blows received from low lying brush. Further, the combination of the small diameter molding and braided sleeve gives the antenna flexibility and, therefore, further protection from damage from repeated blows without the use of mounting springs or other shock absorbing devices.

In operation, the rubber molding acts as a dielectric medium increasing the bandwidth of the antenna. With a length of 12 inches and a 2 inch diameter, the antenna operates in the frequency band of 220–400 MHz as a quarter wave antenna with a maximum VSWR of 2 to 1. In addition, the nominal impedance of the antenna is 50 ohms, and its power handling capacity is 100 watts. The power handling capacity is limited by the BNC connector and cable used, the antenna itself could handle much higher power level.

Although in the embodiment of the antenna described, the rubber is molded over the copper braided sleeve, it will be appreciated by those skilled in the art that the antenna may also be formed by placing the sleeve outside of the rubber support. Further, the copper braided sleeve in the described embodiment of the antenna may be replaced by any other form of conductive flexible sleeve, such as a conductive coating adhered to the inner surface of the hollow rubber molding.

Figure 2:
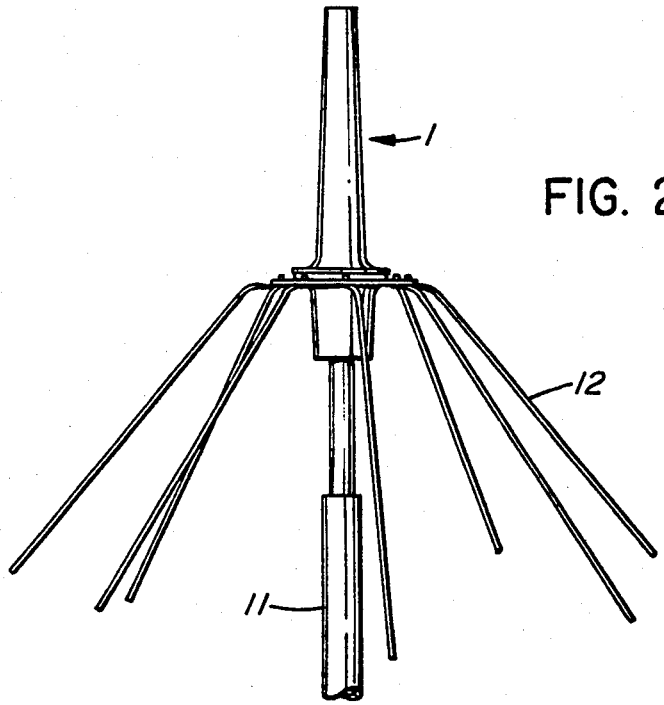
FIG. 2 is a side view of the antenna, mast mounted.

In another embodiment, shown in FIG. 2, the antenna is mounted on a mast 11. To provide a suitable ground plane, eight 18 inch radial rods 12 are mounted, by any conventional means, such as bolting, near the base of the antenna and in electrical contact with the mounting plate.

The rods 12 are equally spaced around the circumference of the base of the antenna and are inclined at a 45° angle. The antenna so mounted also yields a maximum VSWR of less than 2 to 1 through the 220–400 MHz band.

Figures 3, 4, 5:
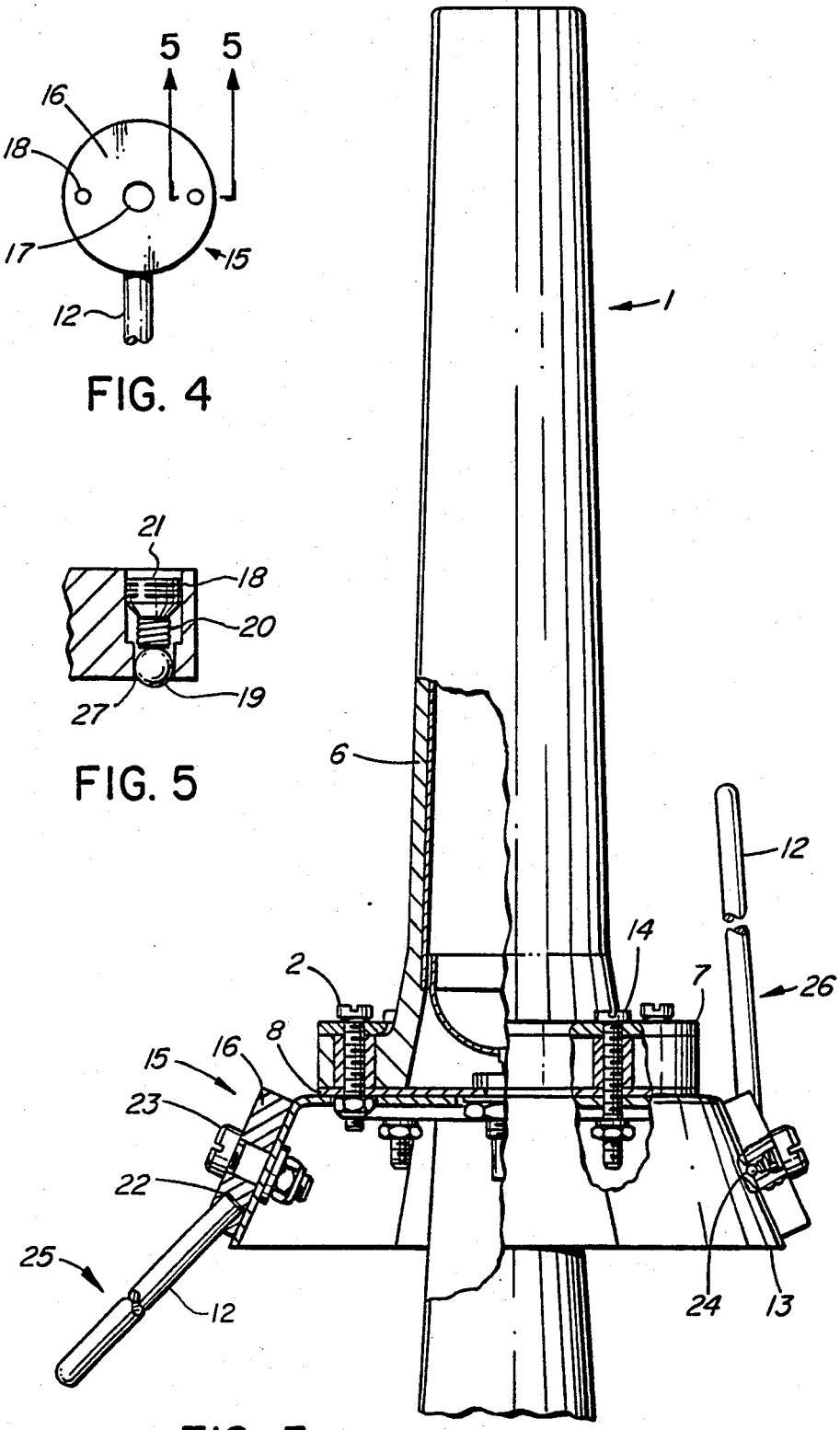
FIG. 3 is a partially sectioned side view of a preferred embodiment of the mast mounted antenna.
FIG. 4 is a back elevational view of a ground plane rod and the ground plane pivot for attaching the rod to the ground plate.
FIG. 5 is a view along line 5—5 of FIG. 4.

Turning now to FIG. 3, a preferred means of mounting the eight ground plane rods 12 near the base of the antenna is shown. A ground plate 13 is mounted to mounting plate 8 by means of four bolts 14 which extend through the metal securing ring 7, flared end of the dielectric 6, mounting plate 8, and ground plate 13. Ground plate 13 is a cup shaped element having a base with eight sides extending therefrom. Each side has a substantially planar outer surface. The base is provided with openings through which bolts 14 may extend, a central opening through which input conductor 9 may be disposed, and two additional openings through which the ends of bolts 1 and their associated nuts may be disposed. A ground plane rod pivot 15 is rotatably mounted to each of the eight sides of the ground plate 13.

Referring to FIG. 4, the ground plane rod pivot 15 includes a base element 16 with a central through bore 17 and two diametrically opposite through bores 18 located near the circumference of the base element.

As seen in FIG. 5, bore 18 is threaded along a portion of its length from the front surface of the base element 16. Further, bore 18 narrows at the back surface of the base element 16 by reason of a tapered lip 27. Disposed within the unthreaded portion of each bore 18 is a ball bearing 19. Lip 27 is dimensioned so that ball bearing 19 may not pass by the lip but may extend beyond the back surface of the base element 16. A helical spring 20 is disposed within bore 18 adjacent the ball bearing 19. A set screw 21 is threaded into the threaded portion of bore 18 to such a distance that it compresses spring 20 against ball bearing 19 thereby biasing the ball bearing against the lip 27.

Returning to FIG. 3, it is seen that a ground plane rod 12 is disposed within bore 22 located in each base element 16. the ground plane rod may be secured in the bore 22 by brazing.

When mounted, the back surface of each base element 16 is disposed adjacent the outer surface of a side of ground plate 13. Considering one mounted ground plane pivot 15, shoulder screw 23 passes through central bore 17 of the base element 16 and through an opening provided in the side of ground plate 13. A flat washer is located adjacent the inner surface of the side of ground plate 13 over shoulder screw 23 and a nut threaded on shoulder screw 23 is located adjacent the washer. The nut is threaded on the shoulder screw 23 to a distance such that the ball bearings 19 yield to the outer plane surface of the side of ground plate 13. With this arrangement, ground plane pivot 15 may rotate about an axis defined by shoulder screw 23.

The outer surface of the side of ground plate 13 contains two hemispherical recesses 24 disposed diametrically opposite each other in the path taken by the ball bearings 19 when the mounted ground plane pivot is rotated. Due to the biasing effect of springs 20 and the fact that the ball bearings 19 have yielded to the outer plane surface of the side of ground plate 13, the ball bearings enter the recesses 24 when the ground plane pivot 15 is rotated so that the ball bearings are positioned over the recesses 24. This results in locking the ground plane pivot in place, that is, it requires a much greater force to dislodge the ball bearings from the recesses 24 than that required to rotate the pivot when the ball bearings contact the plane outer surface of the side of ground plate 13.

Bore 22 is equidistant from each bore 18 (and hence from each ball bearing 19). Further, when the antenna is vertically mast mounted, recesses 24 are disposed in a horizontal plane. Because of this spatial arrangement, ball bearings 19 will lock the ground plane rod in two positions, one illustrated at reference numeral 25, where the rod extends downwardly in an operational position, and the other, illustrated at reference numeral 26, where the rod extends upwardly in a position useful for storing the antenna with an attached ground plane assembly.

When the antenna of this embodiment is mast mounted as shown in FIG. 3, the sides of ground plate 13 deviate 25° from the vertical. In addition, because of the angle of bores 22, each ground plane rod 12 deviates 20° from the plane of its respective ground plate side. In consequence of these angles, ground plane rods 12 are inclined 45° from the vertical when in operational position, and when in the position useful for storage, they are declined 5° from the vertical in a direction toward the antenna 1.

It will be appreciated by those skilled in the art that ball bearings 19, which are biased beyond a surface of the base element, may be replaced by any other yieldable protuberance which extends beyond a surface of the base element. It will also be appreciated that the yieldable protuberances could be associated with the ground plate and the recesses provided in the base element.

While only a limited number of embodiments have been illustrated and described, other variations may be made in the particular design and configuration without departing from the scope of the invention as set forth in the appended claims.

What is claimed is:

1. A broadband antenna comprising a hollow electrically conductive flexible sleeve, a truncated conical flexible tubular support of dielectric material disposed along and surrounding and adhering to said sleeve, the dielectric material increasing the bandwidth of the antenna, a conductive base mounting plate holding said sleeve and dielectric material in an upright position, a conductive ring secured at the lower end of said sleeve within said dielectric, said conductive ring and lower sleeve end being spaced above said mounting plate, said dielectric having a flared base below said ring secured to said plate, signal feed means connected through said base plate to said ring, a support member secured to said mounting plate, a plurality of pivotable rods extending radially from said support member, means for pivotally securing said plurality of rods to said support member for selective movement in upward and downward positions and forming an artificial ground plane in said downward position and including a plurality of base members spaced about said support member, each base member being secured to a respective rod, a plurality of yieldable protuberances each associated with a respective base member and an adjacent area of said support member and located on one of said respective base member and adjacent area of said support member, a pair of recesses located on the other of said respective base member and adjacent area of said support member, and means to rotatably mount each said base member to said support member so that the respective protuberance yields during rotation of said base member on said support member and engages one of said recesses in the path of rotation to hold said base member and rod in a selected position.

2.

The antenna of claim 1 wherein said hollow sleeve includes flexible braided electrical conductors, the sleeve permitting transverse flexure.

3.

The antenna of claim 1 wherein said sleeve is a conductive coating adhered to the inner surface of said dielectric, the coating permitting transverse flexure.

4. The antenna of claim 1 including a conductive cap secured at the upper end of said sleeve, said cap being molded into the flexible dielectric, the height of said sleeve being substantially one quarter wavelength at the operating frequency band.

5. The antenna of claim 1, wherein the truncated conical support is made of an elastomeric material having dielectric properties.

6. The antenna of claim 5, wherein the dielectric material is neoprene rubber.

7. The antenna of claim 1 wherein said yieldable protuberances are located on respective said base members and said recesses are in said adjacent area of said support member.

8. The antenna of claim 7 wherein each said yieldable protuberance on a respective base member is selectively engageable with said pair of recesses in said adjacent support member area to selectively hold the respective rod in a downward operating position and an upward storage position.

9. The antenna of claim 8 wherein each said base member includes a pair of diametrically opposing bores and a pair of respective yieldable protuberances, each of said yieldable protuberances including spring biased ball bearings secured within and extending from respective said bores for engagement with said pair of recesses.

* * * * *